United States Patent [19]

Rubin

[11] 4,129,423

[45] * Dec. 12, 1978

[54] STABLE LIQUID ABRASIVE COMPOSITION SUITABLE FOR REMOVING MANGANESE-ION DERIVED DISCOLORATIONS FROM HARD SURFACES

[75] Inventor: Fred K. Rubin, Leonia, N.J.

[73] Assignee: Lever Brothers Company, New York, N.Y.

[ * ] Notice: The portion of the term of this patent subsequent to Sep. 20, 1994, has been disclaimed.

[21] Appl. No.: 790,124

[22] Filed: Apr. 22, 1977

Related U.S. Application Data

[63] Continuation-in-part of Ser. No. 679,521, Apr. 23, 1976, Pat. No. 4,049,467.

[51] Int. Cl.[2] ..... B08B 3/08

[52] U.S. Cl. ..... 51/304; 51/308; 134/2; 134/3; 252/82; 252/86; 252/89 R

[58] Field of Search ..... 106/3; 51/303, 304, 51/305, 306, 307, 308, 309; 252/89 R, 82, 86, 87, 132, 136; 134/2, 3

[56] References Cited

U.S. PATENT DOCUMENTS

| | | | |
|---|---|---|---|
| 3,607,161 | 9/1971 | Monick | 51/307 |
| 3,653,931 | 4/1972 | Borchert et al. | 106/3 |
| 3,754,941 | 8/1973 | Burke | 51/307 |
| 3,966,432 | 6/1976 | Rayner | 106/3 |
| 4,049,467 | 9/1977 | Rubin | 252/89 R |

*Primary Examiner*—Donald J. Arnold

*Attorney, Agent, or Firm*—Michael J. Kelly; Melvin H. Kurtz; James J. Farrell

[57] ABSTRACT

Pourable, stable, liquid, abrasive compositions capable of removing manganese-ion derived discolorations from hard surfaces comprising a solid phase homogeneously dispersed and stabilized within an aqueous liquid phase are disclosed. Said solid phase comprises a water insoluble abrasive material. Said liquid phase comprises a stabilizing mixture, of a tertiary mixture of synthetic anionic surfactant, soap, and a nonionic surfactant, and an electrolyte system, said system comprising a stain removing amount of at least one electrolyte selected from the group consisting of an alkali metal salt of dihydroxy maleic acid, an alkali metal salt of dihydroxy tartaric acid, and mixtures thereof.

5 Claims, No Drawings

STABLE LIQUID ABRASIVE COMPOSITION SUITABLE FOR REMOVING MANGANESE-ION DERIVED DISCOLORATIONS FROM HARD SURFACES

BACKGROUND OF THE INVENTION

1. Field of the Invention

This invention relates to compositions suitable for removing the discolorations on hard surfaces caused by water borne manganese ions. These discolorations are particularly evident on hard surfaces associated with compositions containing chlorinating compounds in conjunction with water containing manganese ions. In particular, this invention is related to a liquid scouring composition that is provided with a means for chemically assisting the removal of manganese ion induced stains.

Liquid scoures have recently entered the market place. These compositions are characterized by the fact that they usually consist of an abrasive material in some sort of liquid medium, the liquid medium usually containing a surfactant to aid in the removal of soil. Also known are compositions wherein the abrasive, usually an insoluble material is suspended in the liquid medium and is prevented from settling out of the medium by the composition of the liquid medium. Examples of such products are disclosed in Jones et al. U.S. Pat. No. 3,281,367; Rayner, U.S. Pat. No. 3,966,432; Gangwish, U.S. Pat. No. 3,20,285; Cambre, U.S. Pat. No. 3,522,186, and Nakajima et al., U.S. Pat. No. 3,677.954.

Such products are effective for removing many kinds of soiling and discoloration and perform quite adequately on smooth and unabraded surfaces. However, these compositions are less effective on scratched surfaces, and surfaces having crevices or recesses where space is too narrow to allow physical cleaning with the scourer. Thus, old or worn bathtubs, sinks or bathroom tile walls, which are frequently found to be discolored by manganese ion induced stains can prove to be resistant to cleaning via the ordinary scouring action of existing products.

With respect to these manganese ion induced stains, it has been observed for some time that metallic surfaces such as gold, silver, platinum and certain non-metallic surfaces including chinaware, glass, porcelain and plastic, and those surfaces such as are found inside automatic dishwashing machines and other similar household applicances as well as bathroom ceramic, formica and other surfaces found around the home, become discolored when contacted with detergent formulations containing chlorinating agents in the presence of manganese ions. Additionally, the same manganese ion discoloration has been found to occur on the surfaces of swimming pools when certain oxidizing agents, as previously discussed, are employed for treating the pool water. This discoloration is particularly noticed when the aforementioned elements are brought together at elevated temperatures as those usually associated with washing appliances. Since the water of many communities contains sufficient concentrations of manganese ions to cause discoloration of hard surfaces, it is apparent that a serious problem exists in this regard.

The discoloration, previously referred to, occurs usually in the presence of manganese ions when halogenating or other oxidizing compounds are present. The rate at which the discoloration appears is associated with the relative amounts of manganese ion and oxidizing compound present. The staining is particularly rapid when the oxidizing agent is present at the levels associated with the use of a commercial chlorinated dishwasher product.

The following halogenating compounds have been found to induce discoloration: sodium and potassium dichloroisocyanurate, dichloroisocyanuric acid, trichloroisocyanuric acid, dichlorodimethylhydantoin, N,N-dichloro-p-toluene-sulfonamide, sodium chlorite and chlorine. The compounds, in the presence of manganese ion bearing water, will cause discoloration when used alone or when incorporated into detergent compositions. Elemental bromine has also been found to cause discloration of hard surfaces in like manner.

While the aforementioned compounds are all nonalkaline halogenating agents, it should not be inferred that the discoloration will not occur in the presence of alkaline chlorinating agents. To the contrary it has been found that the discoloration is also caused when alkaline chlorinating compounds are present along with the water borne manganese ions. Typical examples of these compounds include: calcium and sodium hypochlorite and chlorinated trisodium phosphate.

While the aforementioned examples produce the characteristic stain under the previously outlined conditions, it is not to be implied that the discoloration will occur only with these particular agents. In actuality, the discoloration of the hard surface will occur with any agent sufficiently strong to oxidize manganese ions. In fact, when the water is present in a thin film on hard surfaces, oxidation may in fact occur due to exposure to the air. What should be noted, however, is that both elements, the manganese ions and the oxidizing agent, must be present. Thus when either manganese ions or the oxidizing materials are removed, it is observed that no discoloration occurs.

2. The State Of the Art

The art in this area has dealt primarily with inhibiting or preventing the discoloration rather than the expost facto removal of the same.

There is disclosed in the art the use of gluconate ions to inhibit discoloration. Rubin, U.S. Pat. No. 3,303,104. This reference, however, is limited to the prevention of discoloration and does not deal with the removal of such discoloration once formed.

There has also been disclosed the use of acids as either rinse aids or solubilizers in detergent compositions. Wedell, U.S. Pat. No. 3,481,881. van Dyk, U.S. Pat. No. 3,620,929. Again, however, this reference is not directed to the object of the instant invention.

It has also been disclosed that certain acids can under certain conditions remove manganese ion deposits. Hnizda, U.S. Pat. No. 3,682,702. However, the acids disclosed must fall within specific formula constraints and be of specific ionization potential to be effective.

The use of tetrahydroxysuccinic acid and the salts thereof for the purpose of replacing phosphate builders has been disclosed. Cheng, U.S. Pat. No. 3,776,851. However, this disclosure is severely limited to the incorporation of the compound as a detergent builder. Moreover, the compositions disclosed are limited to those producing in situ pH values of greater than 8.5 to provide utility. In addition, there is clear indication of lack of utility as builders for those particular salt compounds that interfere with chelation.

Commonly assigned Lamberti SN 378,841 claims the use of certain dihydroxyfumeric salts as a builder in detergent compositions. The stain removing capabilities are unrecognized in this disclosure, and because of functionality the liquid compositions can not contain less than 15 percent surfactant.

It has been disclosed that L-ascorbic acid is effective in removing incrustations containing iron and manganese deposits from the walls of drinking water tanks. German Auslegeschrift No. 2040546. It is not apparent from this disclosure if the deposits so treated are analogeous to the type of discoloration of the instant invention. Moreover, the use of L-ascorbic acid is not predictive of the results obtained by the compounds of the instant invention due to the structural and chemical dissimilarity of L-ascorbic acid and Applicant's compounds.

As stated previuosly, various liquid abrasive compositions are known in the art, however, these are limited in their effectiveness on surfaces that are abraded or in some other way resist complete cleaning via the use of abrasive.

While the art does provide various different solutions to the manganese staining problem, they have many disadvantages, among them being toxicity, corrosivity and incompatibility in formulation, and lack of effectiveness.

SUMMARY OF THE INVENTION

The Basic Disclosure

In Applicant's parent application, Ser. No. 679,521, which is incorporated in its entirety herein by reference, Applicant disclosed that he had discovered that certain polyhydroxycarboxylic acids, the alkali metal salts of these acids and mixtures thereof when used alone or in various compositions, provide a non-toxic, non-corrosive and highly effective means for the removal of discolorations caused by water borne manganese compounds. The specific aforementioned acids are of the general formula:

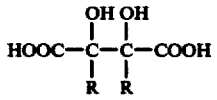

wherein both R groups are simultaneously either hydroxy or are absent. In the case where the R groups are absent, a double bond is formed between the adjacent hydroxy carbons. Specific examples of such acids are dihydroxymaleic acid:

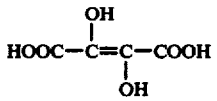

and dihydroxytartaric acid;

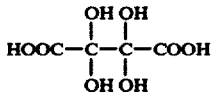

As can be noted in the previous structures only one structural isomer of dihydroxymaleic acid is shown. This form is the trans configuration. As is well known in the art, only this single isomer of dihydroxymaleic has been shown to exist. This is also known in the chemical art as dihydroxyfumaric acid.

As stated above, it was also discovered that the salts of the aforementioned acids as well as mixtures of the various salts and acids were effective means for discoloration removal. These salts are of the general formula:

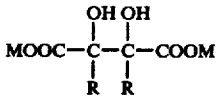

wherein R is as previously described and wherein at least one M per molecule is an alkali metal and in the case where only one M on a particular molecule is an alkali metal the remaining M is hydrogen. As is well known, the actual degree of substitution of alkali metal salt in final use formula will be dependent upon the pH of that formula.

Hereinafter, for the purpose of brevity and ease of reading the polyhydroxycarboxylic acids, the alkali metal salts of those acids and mixtures thereof, will be collectively referred to as the "hydroxy compounds". Reference to either the acid form or salt forms of the polyhydroxycarboxylic acids will be made as the "hydroxy acids" or "hydroxy salts", respectively.

The mechanism by which the hydroxy compounds of the instant invention remove manganese discolorations is not precisely known. Discoloration is not a function of acidity nor does it appear to be solely the result of manganese chelation. Although not wishing to be bound by the following statement, it is theorized that irreversible reduction of colored manganese oxidation compounds by the hydroxy compounds is a prime factor in discoloration removal.

As stated in the parent application, Applicant had examined other non-toxic, non-corrosive acids such as citric, gluconic and tartaric acids and had found them considerably less effective than the hydroxy compounds of this invention as evidenced by both the speed and degree of tarnish removal. Additionally, the alkali metal salts of citric, gluconic and tartaric acids are completely ineffective in the removal of manganese induced hard surface discoloration in contrast to the hydroxy salts of the instant invention which are highly effective.

In his parent application, Applicant sets forth various methods for removing discolorations and compositions for that purpose. The previously disclosed methods and compositions are as follows:

The most efficient method of removing discoloration from dishes or machine interiors is by means of a separate treatment with the hydroxy compounds without the presence of a dishwasher detergent, because commercial dishwasher detergents generally contain a chlorinating agent which would be inactivated by their presence.

While the hydroxy compounds may be added directly to the dishwashing machine or other appliance, it is preferable to add them in a less concentrated form, such as a component of a dishwasher hard surface discoloration removing rinse agent, e.g. in a powder, diluted with an inert material such as sodium sulfate, as a tablet or pellet or in the form of an aqueous solution. For the purpose of simplification, these type compositions will be referred to collectively as "rinse agents." In such instances, it is convenient and helpful to combine various known surfactants and related compounds into such rinse agents to facilitate the flushing and carrying away of residues as well as the enhancement of the wetting of the hard surfaces.

Removal of manganese induced discolorations by the hydroxy compounds is not limited to automatic dishwashing, but extends to all areas where manganese derived discolorations or tarnishes can be found and are objectionable. Thus, it was found that brown bathtub stains can readily be removed by treating the same with the hydroxy compounds of the instant invention. Further, it was disclosed that the invention was not limited to household appliances, but has broad application to any commercial or industrial situation where such discolorations are encountered. These applications include, but are not limited to, any metallic finishing or preparation procedure such as jewelry manufacture or electrical component finishing, glass and enamel manufacture and finishing and other such applications where such discolorations are found.

As previously stated, the hydroxy compounds of the invention may be utilized as an essential component of either a hard surface cleaning composition, a scouring powder or as various other forms of a dishwasher or appliance rinse agent.

With respect to an aqueous rinse product, it was disclosed that any amount, including a simple slurry of the hydroxy compounds in water, is functional. However, with aqueous applications, it is preferred to employ a homogenous product, therefore a slurry is not preferred, and lesser concentrations of the compounds in solution should be employed. Accordingly, the amount of hydroxy compounds in such an application preferably ranges from about 0.001% to the limit of solubility of the partiuclar hydroxy compound being employed. This limit of solubility will, of course, be affected by the presence of other adjuvants. Additionally, when such a rinse agent is meant, in use, to be further diluted, the range of hydroxy compound should be such to provide a concentration of about 0.001% to 0.5% in final dilution. In such cases, the hydroxy compound in such rinse agent should preferably be in the range of about 0.3% to about 16% of the total composition. A preferred range in final dilution is from about 0.005% to about 0.5% with the most preferable range in final dilution being from about 0.05% to about 0.5%. One skilled in the art knowing the particular application, i.e. capacity of the appliance being treated and mode of treatment (e.g. the water capacity of a dishwasher and the size of the product dispenser) can determine the particular concentrations required in the rinse aid.

Additionally, it was disclosed that liquid hard surface discoloration removing compositions can be in the form of a liquid scouring composition including various other components such as alkali metal hydroxides for the control of pH, colorants, perfume and abrasives such as silica, kaoline, calcite, dolomite, pumice stone, scoria, feldspar, ground marble and other ground rock as well as other abrasives well known in the art and mixtures of these various abrasives. Includable also are such things as surfactants and builders. Surfactants that may be employed include, but are not limited to, alkylsulfates where preferably the alkyl chain varies from 8 to 18 carbons in length; alkylbenzene sulfonates where preferably the alkyl moiety varies from 8 to 18 carbons in length; ethoxylated alkylsulfates where preferably the alkyl moiety is from 8 to 18 carbon atoms in length and where preferably the degree of ethylene oxide (EO) substitution ranges from one to ten moles of EO per molecule; sulfonated ethoxylated alkyl phenols where preferably the alkyl moiety varies from 6 to 16 carbon atoms in length and where preferably the EO substitution ranges from one to fifteen moles of EO per molecule; sulfated fatty esters of acids or alcohols where preferably the chain length of the acids vary from 7 to 18 carbon atoms and the chain length for the alcohols varies from 7 to 18 carbons in length; $\alpha$-olefin sulfonates, alkyl sulfosuccinates where preferably the alkyl moiety varies from 8 to 18 carbon atoms in length; N-methyl taurides; alkyl monoethanolamides where the alkyl moiety preferably varies from 8 to 18 carbons in length, alkyl diethanolamides where the alkyl moiety preferably varies from 8 to 18 carbons in length, glycerolamides, tris-(hydroxymethyl)-methylamides and amine oxides where preferably the alkyl chains vary from 8 to 18 carbon atoms, as well as the sodium, potassium, lithium or ammonium fatty acid soaps where preferably the alkyl chain of the soaps varies from 7 to 22 carbons in length. Builders may be employed to provide improved detergency when such surfactants are also employed. These builders include, but are not limited to, alkali metal salts of orthophosphates, polyphosphates, carbonates, borates, ethylene diaminetetraacetic acid, nitrilotriacetic acid and citric acid. The last three mentioned acids may also be used in the acid or various alkali metal salt forms. Also contemplated is the use of carboxymethyloxysuccinate (CMOS) and carboxymethyloxytartronate. The builders may be present at levels of about 2% to about 40% of the composition. Preferably they are present at about 10% to about 20% of the composition. It is highly desirable for the purpose of homogeneity and appearance to have liquid scouring compositions be substantially stable. When abrasives such as those described above are used in the composition described above, it is not uncommon to have the abrasives settle out, sometimes quite rapidly. Substantially stable, pourable suspensions of finely-divided water-insoluble abrasive material can be fabricated comprising water, an anionic surface active agent and a nonionic surface active agent. Preferably these compositions will also contain a fatty acid alkanolamide. A complete description of these suspensions will be found in Jones U.S. Pat. No. 3,281,367 issued Oct. 25, 1966 and incorporated herein by reference. These compositions are the subject matter of this C-I-P application and will be treated in detail shortly.

Likewise, it was disclosed that in powdered hard surface cleaning compositions, ranges of concentration can best be determined by the final dilution use concentrations previously disclosed. For practical purposes, ranges of hydroxy compounds of about 0.5% to about 20% achieve final dilution levels in use within the ranges previously disclosed. The preferred range for these compositions will be from about 10% to about 18% and generally the most preferred level of the hydroxy compounds is about 16% of the powdered composition. Again, as with the aqueous rinse aid, the most practical concentrations for particular purposes can readily be determined by one skilled in the art.

It was disclosed that the hydroxy compounds at concentrations of about 1% to about 10% in scouring powders removes tarnishes and discolorations excellently. A preferred range in products of this type ranges in concentrations of about 4% to about 8%. Again the most practical concentrations for a given application can be determined by one skilled in the art.

Typical powdered hard surface discoloration removing compositions that were disclosed include such things as fillers selected from the group including sodium sulfate, sodium chloride, soda ash, sodium bicarbonate, sodium diacetate, sodium sesquicarbonate, sodium borates, sodium silicates, sodium phosphates, sodium acetate, as well as colorants, perfumes and optionally surfactants such as compounds containing an organic hydrophobic group and a hydrophilic group which is a reaction product of a solubilizing group such as carboxylate, hydroxyl, amido or amino with ethylene oxide or with the polyhydration product thereof, polyethylene glycol.

Examples of nonionic surface active agents which may be used, included the condensation products of alkyl phenols with ethylene oxide, e.g., the reaction product of one mole of isooctyl phenol with about 6 to 30 moles of ethylene oxide; condensation products of higher fatty alcohols with ethylene oxide such as the reaction product of one mole of tetradecyl alcohol with eleven moles of ethylene oxide, monoesters of hexahydric alcohols and inner ethers thereof such as sorbitan monolaurate, sorbitan mono-oleate and the condensation products of these esters with ethylene oxide and mannitan monopalmitate, and the condensation products of polypropylene glycol with ethylene oxide as wetting agents. While nonionic surfactants are preferred, the use of anionic and cationic surfactants are not excluded. As a matter of fact, other nonionics as well as suitable anionics and cationics are disclosed in Schwartz and Perry, "Surface Active Agents", Vols. I and II (1949 and 1958, respectively).

It was disclosed that these compositions may be utilized also in the preparation of tarnish removing tablets by incorporating a binder such as starch, polyvinyl alcohol, carbowaxes, etc. all of which are all known to the art.

Most scouring powders contain either soap or a surfactant with a builder and an abrasive. The surfactants may be selected from a wide range of materials such as anionic detergents. Among these may be cited the higher alkyl mononuclear aromatic sulfonates such as the higher alkyl benzene-sulfonates containing from 10 to 16 carbon atoms in the alkyl group in a straight or branched chain, e.g., the sodium salts of decyl, undecyl, dodecyl (lauryl), tridecyl, tetradecyl, pentadecyl, or hexadecyl benzenesulfonate and the higher alkyl toluene, xylene and phenol sulfonates; alkyl naphthalenesulfonate, ammonium diamyl naphthalenesulfonate and sodium dinonylnaphthalenesulfonate.

Other anionic detergents are the olefin sulfonates, including long chain alkenesulfonates, long chain hydroxyalkanesulfonates or mixtures of alkenesulfonates and hydroxyalkanesulfonates. These olefin sulfonate detergents may be prepared, in known manner, by the reaction of $SO_3$ with long chain olefins (of 8-25, preferably 12-21 carbon atoms) of the formula $RCH{=}CHR_1$, where R is alkyl and $R_1$ is alkyl or hydrogen, to produce a mixture of sultones and alkenesulfonic acids, which mixture is then treated to convert the sultones to sulfonates. Examples of other sulfate or sulfonate detergents are paraffin sulfonates, such as the reaction products of alpha olefins and bisulfites (e.g. sodium bisulfite), e.g. primary paraffin sulfonates of about 10-20, preferably about 15-20, carbon atoms; sulfates or higher alcohols; salts of α-sulfofatty esters (e.g. of about 10-20 carbon atoms, such as methyl-α-sulfomyristate or α-sulfotallowate).

Examples of sulfates or higher alcohols are sodium lauryl sulfate, sodium tallow alcohol sulfate. Turkey red oil or other sulfated oils, or sulfates of mono- of diglycerides of fatty acids (e.g. stearic monoglyceride monosulfate), alkyl poly (ethenoxy) ether sulfates such as the sulfates of the condensation products of ethylene oxide and lauryl alcohol (usually having 1 to 5 ethenoxy groups per molecule); lauryl or other higher alkyl glyceryl ether sulfonates; aromatic poly (ethenoxy) ether sulfates such as the sulfates of the condensation products of ethylene oxide and nonyl phenol (usually having 1 to 20 oxyethylene groups per molecule preferably 2-12).

The suitable anionic detergents include also the acyl sarcosinates (e.g. sodium laurolysarcosinate) the acyl esters (e.g. oleic acid ester) of isothionates and the acyl N-methyl taurides (e.g. potassium N-methyl lauroyl- or oleyl tauride). These detergents may be used at levels of from about 2% to about 5%.

The builders may be selected from the alkali metal salts of orthophosphates, polyphosphates, carbonates, borates, ethylenediaminetetraacetic acid, nitrilotriacetic acid, citric acid. The last three mentioned acids may be used in the acid or alkali metal salt forms. Also contemplated is the use of carboxymethyloxysuccinate (CMOS) and carboxymethyloxytartronate. The builders may be present at levels of from about 3% to about 10%, preferably from about 3% to about 6%.

The abrasives may be selected from powdered silica, pumice stone, scoria, feldspar, calcite, dolomite, or ground rock. Minor components such as colorants and perfumes may also be added.

It was also disclosed that other alkali metal salts of the hydroxy acids such as the lithium salts are operable in the instant invention.

The Continuing Disclosure

With reference to liquid scouring compositions, it has now been discovered that a particularly stable pourable liquid, abrasive, stain removing composition can be obtained that provides for excellent stability with the added benefit of chemical removal of manganese-ion induced discolorations from abraded hard surfaces.

In commonly assigned Jones et al. U.S. Pat. No. 3,281,367, there was disclosed a stable pourable suspension of a finely-divided water insoluble abrasive material in a liquid medium comprising essentially water, an anionic detergent and a nonionic surface active agent. While in Jones, it was disclosed that the anionic detergent may be a synthetic detergent or soap, it was additionally disclosed that a preferable aspect of the invention resided in the use of a mixture of these two types. A preferred form of the Jones invention provides for a suspension of finely-divided water insoluble abrasive material in an aqueous liquid medium containing an alkali-metal salt of a phosphoric acid having a molecular weight below 400, an anionic detergent as previously discussed, and a fatty acid alkanolamide. The preferred mode provided for a product with good lathering, and grease emulsifying properties insured by the addition of the phosphate builder.

Applicant has discovered that a particularly stable system can be obtained using a liquid phase comprising a tertiary mixture of surfactants and an electrolyte system which in combination provide for superior stability. With this liquid phase, it has been found that an abrasive composition may be fabricated containing about 5 to 65 percent by weight of said composition of a water insoluble abrasive material. Surprisingly, however, it has been found that when said electrolyte system comprises at least one compound selected from the group consisting of dihydroxymaleic acid, alkali metal salts of dihydroxymaleic acid, dihydroxytartaric acid, alkali metal salts of dihydroxytartaric acid and mixtures thereof, that unexpected reduction of manganese ion induced discolorations can be obtained, particularly in areas that were heretofor difficult to clean, i.e. abraded surfaces. Specifically, Applicant has discovered that an aqueous, pourable, liquid, abrasive, stain removing composition comprising:

(A) a solid phase, comprising about 5 to about 65 percent, by weight of said composition of a substantially water insoluble abrasive material selected from the group consisting of calcite, dolomite, feldspar, silica flour, quartz, pumice, polishing clays, and mixtures thereof, dispersed and suspended in;

(B) a stabilizing aqueous liquid phase, comprising:

(i) about 1 to about 20 percent of a tertiary surfactant mixture, said mixture consisting essentially of:

(a) about 0.25 to about 10 percent, by weight of said composition, of an anionic surfactant selected from the group consisting of alkylaryl sulphonates, alkyl sulphates, acylaminoalkane sulphonates, and mixtures thereof;

(b) about 0.25 to about 10 percent, by weight of said composition, of a soap wherein said soap is an alkali metal salt of a ten to twenty-two carbon fatty acid; and (c) about 0.50 to about 10 percent, by weight of said composition of a nonionic surfactant selected from the group consisting of a fatty acid alkanolamide wherein the fatty acid moiety of said amide contains about 8 to about 18 carbon atoms, an alkyl-phenolethylene oxide condensate, a fatty alcoholethylene oxide condensate and mixtures thereof, wherein the ratio of said soap to said synthetic anionic in said mixture is about 1:3.2 to about 1:0.8, and wherein the ratio of said synthetic anionic surfactant plus said soap to said nonionic surfactant is about 0.6:1 to about 1:0.9; and (ii) about 3 to about 20 percent of an electrolyte system comprising at least one compound selected from the group consisting of dihydroxymaleic acid an alkali metal salt of dihydroxymaleic acid, a dihydroxytartaric acid, an alkali metal salt of dihydroxytartaric acid, and mixtures thereof, will provide for a stable liquid abrasive cleaner with the added and unexpected benefit of chemical stain removal.

In particular, a preferred composition exhibiting superior stability and stain removing comprises:

(A) a solid phase comprising about 5 to about 65 percent by weight of said composition of a substantially water insoluble abrasive material selected from the group consisting of calcite, dolomite, feldspar, silica flour, quartz, pumice, polishing clays, and mixtures thereof, dispersed and suspended in;

(B) a stabilizing aqueous liquid phase, comprising:

(i) about 1 to about 20 percent of a tertiary surfactant mixture, said mixture consisting essentially of:

(a) about 0.25 to about 10 percent, by weight of said composition, of an alkylaryl sulphonate anionic surfactant;

(b) about 0.25 to about 10 percent, by weight of said composition, of a soap wherein said soap is an alkali metal salt of a 10 to 22 carbon fatty acid; and (c) about 0.50 to about 10 percent, by weight of said composition of a fatty acid dialkanolamide wherein the fatty acid moiety of said amide contains about 8 to about 18 carbon atoms, wherein the ratio of said soap to said alkylanyl sulphonate in said mixture is about 1:3.2 to about 1:0.8, and wherein the ratio of said alkylaryl sulphonate plus said soap to said fatty acid dialkanolamide is about 0.6:1 to about 1:0.9; and (ii) about 3 to about 20 percent of an electrolyte system comprising at least one compound selected from the group consisting of dihydroxymaleic acid, an alkali metal salt of dihydroxymaleic acid, dihydroxytartaric acid, an alkali metal salt of dihydroxytartaric acid, and mixtures thereof.

The liquid phase may itself contain a material in suspension and the term "liquid phase" is used in this specification to denote the whole composition referred to, exclusive only of the abrasive material suspended in it.

The nature and proportions of the ingredients must be so chosen that they form a substantially stable suspension in accordance with the invention. While apparently trivial changes in composition may destroy the stability of a suspension, stable products according to the invention may generally be prepared by following the instructions and guidance given in following paragraphs and in the many specific examples. Simple experimentation will show whether any particular composition of materials forms a satisfactory stable suspension.

The abrasive to be used may be any finely-divided water-insoluble abrasive material normally used in abrasive detergent compositions, such as finely-divided silica, feldspar, pumice, Kieselguhr, emery, carborundum, calcite, dolomite, quartz, polishing clays and mixtures thereof. Where the compositions are intended for ordinary abrasive cleansing the particle size should be such as to give effective abrasive action without undue scratching, and any abrasive meeting this requirement can be used to give stable compositions according to the invention. Typical particle sizes with respect to abrasive action of this type are such that substantially the whole of the material passes a sieve with apertures of 104 microns and at least 80 percent passes a sieve with apertures of 53 microns, and abrasive within this range may be effectively included in the compositions of the invention.

The amount of abrasive to be incorporated in the compositions of the invention may vary within wide limits, in accordance with the desired properties of the composition; normally any particular liquid medium which has suspending properties will suspend any amount of abrasive. Usually at least about 5 percent, by weight of the total composition, will be required to give effective abrasive action and amounts of up to 65 percent may often be satisfactorily incorporated to give a product which is still in the form of a pourable liquid. It is preferred to use from 20 percent to 50 percent of abrasive.

As stated previously, the liquid phase, in addition to water, comprises a specific tertiary mixture of synthetic anionic surfactants, soap, and nonionic surfactant in combination with an electrolyte system.

The tertiary mixture of surfactants can be present in the composition from about 1 to about 20 percent by weight of the composition. Above 20 percent it has been found that the composition becomes to viscous for the product to be in an acceptable form i.e. a pourable liquid and often results in a pasty mass that is difficult to use. Most desirably, for this purpose, the surfactant mixture should not exceed about 15 percent. In fact, most of the compositions with a high amount of solid phase will not require a surfactant mixture much in excess of about 10 percent.

The tertiary mixture consists essentially of about 0.25 to about 10 percent, by weight of the composition of a synthetic anionic surfactant; about 0.25 to about 10 percent by weight of the composition of soap; and about 0.50 to about 10 percent by weight of the composition of a nonionic surfactant. Importantly, the ratio of these surfactant ingredients to each other within the mixture is critical in achieving stability. Generally, adequate stability is found wherein the ratio of the soap to the synthetic anionic in the mixture is about 1:3.2 to about 1:0.8, and where the ratio of the combined synthetic anionic and soap to the nonionic surfactant is about 0.6:1 to about 1:0.9. Some deviation from these ratios may be tolerated, however, significant deviation beyond these ranges generally results in an unstable product.

Various anionic synthetic detergents may be employed, in the mixture such as for example alkylaryl sulphonates, alkyl sulphates, acylamino alkane sulphonates and mixtures thereof. Compositions containing acyl isethionates tend to be exceedingly difficult to stabilize. While satisfactory compositions can be made with either acylaminoalkane sulfonates and alkyl sulphates, they tend to give intermediate stability unless additional ingredients are employed. Alkylaryl sulphonates are most preferred.

The soap employed may be any soap of a type normally used in detergent compositions, such as a sodium or potassium soap derived from tallow, palm oil or coconut oil. The maximum amount which can be used with success may depend upon its solubility in water and it may be advantageous to use more soluble soaps such as potassium soaps, especially potassium soaps of "soft" oils such as groundnut oil. A preferred soap that provides excellent stability in this mixture, however, is an alkali metal salt of a blend of tallow and coconut fatty acids. In particular, the sodium salt is desirous. Most preferred is a soap which is the sodium salt of an 85:15 mixture of tallow and coconut fatty acids.

Among the non-ionic surface-active agents which may be of use in the compositions of the invention there may be mentioned the condensation products of lower alkylene oxides, for example, ethylene oxide, with alkylphenols, fatty acids, fatty alcohols, and the like. Particularly satisfactory compositions may be prepared using a fatty acid alkanolamide, preferably a mono- or diethanolamide but other alkanolamides having similar properties such as the isopropanolamides, the glycerolamides and the tris-(hydroxymethyl)-methylamides may also be effective. It is preferred to use a mono- or diethanolamide of a fatty acid having from 8 to 18 carbon atoms in the molecule, especially the mono- or diethanolamide of lauric acid or a mixture of acids rich in lauric acid such as may be obtained from oils such as palm kernel oil or coconut oil. Lauric diethanolamide has been found to be especially satisfactory. Where a large amount of non-ionic surface-active agent is employed some of it may be present as a dispersion in the liquid medium. This does not adversely affect the properties of the composition. A particularly useful nonionic is a blend of lauric and myristic diethanolamide which represents a more preferred mode of the invention.

As stated previously the electrolyte system in combination with the tertiary surfactant mixture is essential to maintain stability. About 3 to 20 percent by weight of said composition, of the electrolyte system must be present to provide for both stabilization and manganese stain removal. The electrolyte system comprises at least one compound selected from the group consisting of dihydroxymaleic acid, alkali metal salts of dihydroxymaleic acid, dihydroxytartaric acid, alkali metal salts of dihydroxytartaric acid and mixtures thereof. While both salts and acids are indicated, generally the salts are employed in this application since in the preferred mode, the composition should have a pH of about 9 to about 11 to insure stability of the soap.

Additional electrolytes may be employed in conjunction with the required hydroxy compounds. These include, but are not limited to such things as sodium tripolyphosphate, alkali metal halides, alkali metal carbonates, alkali metal sulfates, aluminium sulfate, alkali metal salts of carboxylic acids, alkali metal and alkaline earth salts of various synthetic builder compounds such as ethylene diamine tetraacetic acid, carboxymethyloxysuccinate or carboxymethyloxytartronate. Mixtures of these various electrolytes are also contemplated.

It should be pointed out that these electrolyte salts are included for the purpose of composition stabilization and while some may be recognized in the art as detergent builders, their function in these compositions is that of an electrolyte. Builders need not be present.

Generally, a wider range of electrolytes will supply the needed stabilization. In fact, as little as about 0.25 percent of the auxiliary electrolytes will provide quite adequate stability; however, the stain removing hydroxy compounds must be included in a stain removing amount which in this specific composition is found to be at least about 3 percent by weight of the composition to provide rapid action. Exceedingly high amounts of electrolyte; i.e. above about 15 percent by weight of the composition can lead to instability. In fact, when high amounts of the hydroxy compounds are employed, such as about 10 percent, inclusion of auxiliary electrolytes in particular sodium sulfate can sometimes be detrimental to stability of the composition.

Substances such as perfumes, coloring agents and germicides may also be incorporated provided that their nature and amount is not such as to destroy the stability of the compositions. It may, however, be undesirable to attempt to include, in appreciable amounts, other water-soluble compounds, especially those having pronounced hydrotropic properties, such as sodium xylene sulphonate. A co-solvent, such as glycerol, may be present in the liquid medium in amounts comparable to the amounts of anionic and non-ionic materials.

The choice of non-aqueous material and proportions to be use in the liquid medium will be determined, apart from the desirability of having adequate suspending power and stain removing ability, by considerations such as the detergent, lathering and grease-emulsifying properties and the viscosity which the final product is intended to posess. The viscosity of the compositions of the invention is not simply related to the percentage of non-aqueous material in the liquid medium or to the percentage of abrasive in the composition but is a consequence of the compositions as a whole. If an excessive amount of abrasive is added to the liquid medium, however, the resulting product is no longer pourable but in the form of a paste.

Even greater improvement in the stability of the formulation can be achieved through the inclusion of additional optional components. It has been found that when about 0 to about 5 percent of colloidal forming clays such as attapulgite clay are added to the composition, increased stability results.

The compositions of the invention may be prepared as follows. The anionic detergent is added to water at about 60° C. and the mixture stirred until the detergent has dissolved. The solution is allowed to cool to about 40° C. when the non-ionic surface-active agent and any co-solvent are added with gentle stirring. The abrasive is then slowly added, again with gentle stirring, until the whole is thoroughly mixed. Any minor adjunct such as perfume may then be incorporated. Throughout this procedure the mixing must be thorough, but of such a character as to avoid undue aeration.

The preferred compositions of the invention may be prepared by the following procedure. The electrolyte system is added with stirring to twice its weight of water (or less if the finished composition is to contain less than this amount of water) at room temperature, the mixture is warmed at about 60° C. and stirred until a smooth cream free from hard lumps is obtained. The stirring should be as gentle as possible but it has been found that some batches of electrolyte tend to be difficult to disperse and more vigorous stirring may be necessary to form the desired smooth cream. The cream is then allowed to cool to about 40° C. The anionic detergent component is then dissolved in the remaining water at 60° C. and this solution is allowed to cool to about 40° C. when the fatty acid alkanolamide is added with gentle stirring. Evaporation losses in the electrolyte cream and the detergent solution are made up, and the electrolyte cream is then added with gentle stirring to the detergent solution. The abrasive is then slowly added again with gentle stirring, until the whole is thoroughly mixed. Any minor ingredients, such as perfume and coloring matter may then be incorporated. Throughout this procedure the mixing must be thorough but it should be of such a character as to avoid undue aeration.

A desirable method of producing a preferred composition comprises a specific order of addition and the use of two premixes. The first premix mixture comprises the colloidal clay and some of the water of the formula. The second premix comprises the anionic, soap and again some of the water of the composition. With respect of the order of addition, the electrolyte system is dissolved or dispersed in the major fraction of the water, as previously discussed. To this is added the premix containing the colloidal clay. Next the abrasive is incorporated into this mixture whereupon the premix comprising the anionic and soap mixture is added. Finally, the alkyl diethanolamide is incorporated into the mixture whereupon final adjustment in the water content can be made. Generally, mixing of the premixes and the composition is found to be best achieved at a temperature of about 60°-70° C.

The invention will be more fully understood by reference to the following Examples, which are presented for illustrative purposes, and are not to be interpreted as limiting the scope of the invention. All parts and proportions are by weight unless specified otherwise.

EXAMPLE 1

Platinum strips* are immersed in a solution containing one part per million (ppm) of $Mn^{++}$ ions (from $MnSO_4.H_2O$) and 0.3% of a chlorinated automatic dishwasher detergent. The available chlorine content of the solution is approximately 20 ppm. The solution temperature is 140° F. The platinum strips are left in the solution until they have discolored to a uniform deep golden brown resulting from the formation of manganese oxidation compound.

*Platinum strips are a suitable means of replicating the rapid discoloration of metallic ornaments in dinner plates and metal surfaces during dishwashing.

EXAMPLE 2

Tarnished strips as prepared in Example 1 were immersed in solutions of the hydroxy acids at various concentrations at temperatures ranging from about 80° to 130° F. The results of the time and degree of tarnish removal is shown in Table E2.

The data presented in Table E2 shows that the characteristic discoloration produced on the hard surface of Example 1 can be completely removed even at very low concentrations of the hydroxy acid during relatively brief exposure periods. It can be clearly seen that the times required for discoloration are well within the parameters of dishwasher operation (e.g. 120°-135° F. water temperature, 15-20 minute wash cycle).

Table E2

Discoloration Removal By Various Concentrations of the Hydroxy Acids

| Tarnish Removal Agent | % Concentration | Temperature | Degree of Removal | Time Required for Removal. |
|---|---|---|---|---|
| Dihydroxymaleic Acid | 1.0 | 134° F | Complete | 2 sec. |
| Dihydroxymaleic Acid | 0.5 | 100° F | Complete | 12 sec. |
| Dihydroxymaleic Acid | 0.5 | 130° F | Complete | 5 sec. |
| Dihydroxymaleic Acid | 0.05 | 80° F | Complete | 75 sec. |
| Dihydroxymaleic Acid | 0.05 | 130° F | Complete | 30 sec. |
| Dihydroxymaleic Acid | 0.005 | 130° F | Complete | 90 sec. |
| Dihydroxymaleic Acid | 0.001 | 130° F | Complete | 8½ min. |
| Dihydroxytartaric Acid | 1.0 | 124° F | Complete | 13 sec. |
| Dihydroxytartaric Acid | 0.5 | 100° F | Complete | 45 sec. |
| Dihydroxytartaric Acid | 0.5 | 130° F | Complete | 20 sec. |
| Dihydroxytartaric Acid | 0.05 | 100° F | Complete | 2 min. |
| Dihydroxytartaric Acid | 0.05 | 130° F | Complete | 38 sec. |
| Dihydroxytartaric Acid | 0.005 | 100° F | Complete | 21 min. |
| Dihydroxytartaric Acid | 0.005 | 130° F | Complete | 8 min. |

EXAMPLE 3

Part A

Platinum strips as prepared in Example 1 were immersed in various solutions of different organic acids at various temperatures comparative to those expected to be found in automatic dishwashers or home hot water systems. The acids tried included citric, gluconic, acetic, kojic and tartaric. The results of the time and degree of removal appear in Table E3*a*.

The data presented in Table E3*a* indicates that while citric, gluconic and tartaric acids also remove manganese induced discolorations, they do so only at much higher concentrations and longer times relative to the hydroxy acids of the instant invention. This becomes immediately clear upon comparison of the data of Table E2 with that contained in Table E3*a*.

The data associated with acetic acid demonstrates that discoloration removal is not a function of acidity alone as this acid is an example of a non-reducing simple organic acid of comparable acidity.

The data associated with kojic acid indicates that sequestering acids are of little effect.

Part B

To further exemplify the difference between the hydroxy acids and other organic acids, tarnished platinum strips as prepared in Example 1 were exposed to a 5% solution of citric acid at 80° F. It was then observed that it required 3½ minutes to remove the tarnish discoloration despite the relatively high concentration of citric acid in solution. This observation further supports the discovery that the hydroxy compounds of the instant invention in contrast with other organic acids remove tarnish discoloration rapidly and at very low use concentrations (Examples 2 and 3A). Should one wish to maintain a true solution, the upper practical use limit of the dihydroxy maleic acid is in the vicinity of 2.0%, in neat solutions at which point solubility difficulties become noticeable. Dihydroxytartaric acid concentrations above about 1.0% in neat solutions similarly lead to solubility difficulties.

While the acids of the instant invention may be used in concentrations up to the limit of their solubility to effect very rapid tarnish removal, there is no need to operate near the upper limit of the concentration range since solutions as dilute as 0.005% and even 0.001% will still remove tarnish effectively and, at the same time, economically.

Table E3a

| Comparative Data For Various Other Acids | | | | |
|---|---|---|---|---|
| Tarnish Removal Agent | Concentration % | Temperature | Degree Of Removal | Time To Effect Removal |
| Citric Acid | 0.5 | 80° F | complete | 30 mins. |
| Citric Acid | 0.5 | 130° F | complete | 15 mins. |
| Gluconic Acid | 0.5 | 80° F | practically complete | 35 mins. |
| Gluconic Acid | 0.5 | 130° F | complete | 10 mins. |
| Tartaric Acid | 0.5 | 80° F | about 90% complete | 30 mins. |
| Tartaric Acid | 0.5 | 130° F | about 90% complete | 10 mins. |
| Maleic Acid | 0.5 | 100° F | 10% | 30 mins. |
| Maleic Acid | 0.5 | 130° F | practically complete | 10 mins. |
| Glucuronic Acid | 0.5 | 100° F | 50% | 16 mins. |
| Glucuronic Acid | 0.5 | 130° F | complete | 15 mins. |
| Acetic Acid | 0.5 | 80° F | no removal | 30 mins. |

Table E3a-continued

| Comparative Data For Various Other Acids | | | | |
|---|---|---|---|---|
| Tarnish Removal Agent | Concentration % | Temperature | Degree Of Removal | Time To Effect Removal |
| Acetic Acid | 0.5 | 130° F | no removal | 30 mins. |
| Kojic Acid | 0.05 | 120° F | no removal | 5 mins. |

(5-hydroxy-2-(hydroxy methyl)-4H-pyran-4-one)

EXAMPLE 4

Platinum strips are tarnished as described in Example 1. The tarnished strips are immersed in the following solutions as shown in table E4.

This example illustrates the specificity of the hydroxy salt which, in contrast to the salts of the other acids tested, remove tarnish as effectively as does the free acid form. Sodium perborate, known for its manganese removal tendencies, is included for comparative purposes. As noted in Table E4, sodium perborate is considerably less effective than the hydroxy compounds in their salt form.

Table E4

| Comparative Data for the Hydroxy Salts and the Salts of Various Other Acids | | | | |
|---|---|---|---|---|
| Tarnish Removal Agent | Concentration % | Temperature | Degree of Removal | Time to Effect Removal |
| Dihydroxy maleic acid sodium salt | 0.5 | 100° F | Complete | 16 secs. |
| Dihydroxy maleic acid sodium salt | 0.5 | 130° F | Complete | 7 secs. |
| Dihydroxy maleic acid sodium salt | 0.005 | 100° F | Complete | 3 mins. |
| Dihydroxy maleic acid sodium salt | 0.005 | 130° F | Complete | 80 secs. |
| Dihydroxy maleic acid sodium salt | 0.001 | 130° F | 70% | 30 mins. |
| Dihydroxy tartaric acid sodium salt | 0.5 | 100° F | Complete | 8 mins. |
| Dihydroxy tartaric acid sodium salt | 0.5 | 130° F | Complete | 3 mins. |
| Dihydroxy tartaric acid sodium salt | 0.05 | 130° F | 80% | 30 mins. |
| Potassium gluconate | 0.5 | 80° F | No removal | 30 mins. |
| Potassium gluconate | 0.5 | 135° F | No removal | |
| Sodium glucoheptonate dihydrate | 0.5 | 80° F | No removal | 30 mins. |
| Sodium glucoheptonate dihydrate | 0.5 | 135° F | No removal | 30 mins. |
| Sodium tartrate | 0.5 | 80° F | No removal | 30 mins. |
| Sodium tartrate | 0.5 | 135° F | No removal | 30 mins. |
| Sodium citrate | 0.5 | 80° F | Slight removal (about 5%) | 30 mins. |
| Sodium citrate | 0.5 | 135° F | Slight removal (about 5%) | 30 mins. |
| Sodium maleate | 0.5 | 130° F | About 5% | 30 mins. |
| Sodium perborate | 0.5 | 80° F | 70% | 30 mins. |
| Sodium perborate | 0.5 | 135° F | 85% | 30 mins. |

EXAMPLE 5

Platinium strips were tarnished as described in Example 1. The tarnished strips were then immersed in the following compositions:

| Component | Percent Based on 100% Formulation 5A | 5B |
|---|---|---|
| Sodium alkylbenzene sulfonate* | 2.00 | 2.00 |
| Sodium tallow/coco soap* | 0.64 | 0.64 |
| Lauric/myristic diethanolamide* | 2.40 | 2.40 |
| Water | 41.318 | 36.318 |
| Sodium tripolyphosphate** | 4.76 | 4.76 |
| Dihydroxymaleic acid** | — | 5.00 |
| Calcite*** | 48.00 | 48.00 |
| Attapulgite clay+ | 0.50 | 0.50 |
| Ammonia (28% Active)+ | 0.08 | 0.08 |
| Perfume+ | 0.30 | 0.30 |
| Optical Whitener+ | 0.0032 | 0.0032 |

-continued

| Component | Percent Based on 100% Formulation 5A | 5B |
|---|---|---|
| Total | 100.0 | 100.0 |

*tertiary sufactant mixture component
**electrolyte component
***abrasive
+optional ingredient After a contact period of about three minutes without agitation the strips were withdrawn and rinsed with water. Composition 5B had substantially removed the manganese ion discolorations while the strip immersed in composition 5A remained virtually unchanged.

Both compositions exhibited excellent stability under extended storage and exhibited excellent scouring ability on soiled surfaces.

It should be noted that although the hydroxy compound was added in the acid form, sufficient excess alkalinity was present to insure that the hydroxy compound was present in the formula as a salt.

EXAMPLE 6

Ceramic and formica strips were treated by the procedures set forth in Example I to tarnish the platinum strips. A uniform deep golden brown discoloration formed on the surfaces of the ceramic and formica strips resulting from the formation of manganexe oxidation compound. The discolored strips were immersed in the following compositions:

| Component | Percent based on 100% Formulation 6A | 6B |
|---|---|---|
| Sodium alkylbenzene sulfonate* | 2.00 | 2.00 |
| Sodium tallow/coco soap* | 0.64 | 0.64 |
| Lauric/myristic diethanolamide* | 2.40 | 2.40 |
| Water | 56.317 | 41.317 |
| Sodium tripolyphosphate** | 4.76 | 4.76 |
| Dihydroxymaleic acid** | — | 15.00 |
| Calcite*** | 33.0 | 33.0 |
| Attapulgite clay+ | 0.50 | 0.50 |
| Ammonia (28% active)+ | 0.08 | 0.08 |
| Perfume+ | 0.30 | 0.30 |
| Optical whitener+ | 0.0032 | 0.0032 |
| Total | 100.0 | 100.0 |

*tertiary surfactant mixture component
**electrolyte component
***abrasive
+optional ingredient After a contact period of three minutes without agitation the strips were withdrawn and rinsed with water. Composition 6B had completely removed the brown stains from both the ceramic and formica strips. The control composition 6A, did not have any effect on the maganese induced stains on these strips.

Both compositions exhibited excellent stability under extended storage and exhibited excellent scouring ability on soiled surfaces.

It should be noted that the hydroxy compound was added in the free acid form. Insufficient excess alkalinity was present to completely convert the compound to the salt form so that the hydroxy compounds were present in the composition in a mixture of salt and free acid form.

EXAMPLE 7

Ceramic and formica strips were prepared as set forth in Example 6. These strips were then immersed in the following compositions:

| Component | Percent based upon 100% Formulation 7A | 7B |
|---|---|---|
| Sodium alkylbenzene sulfonate* | 2.00 | 2.00 |
| Sodium tallow/coco soap* | 0.64 | 0.64 |
| Lauric/myristic diethanolamide* | 2.40 | 2.40 |
| Water | 56.317 | 41.317 |
| Sodium tripolyphosphate** | 4.76 | 4.76 |
| Sodium dihydroxymaleate** | — | 15.0 |
| Calcite*** | 33.00 | 33.00 |
| Attapulgite clay+ | 0.50 | 0.50 |
| Ammonia (28% Active)+ | 0.08 | 0.08 |
| Perfume+ | 0.30 | 0.30 |
| Optical Whitener+ | 0.0032 | 0.0032 |
| Total | 100.0 | 100.0 |

*tertiary surfactant mixture component
**electrolyte component
***abrasive
+optional ingredient After a contact period of about eight minutes without agitation the strips were withdrawn and rinsed with water. Composition 7B had substantially removed the brown stains from both the ceramic and formica strips. The control, composition 7A, did not have any effect on the manganese ion induced stains.

Both compositions exhibited excellent stability under extended storage and exhibited excellent scouring ability on soiled surfaces.

EXAMPLE 8

Ceramic strips were prepared as set forth in Example 6. These strips were then immersed in the following compositions:

| Component | Percent Based Upon 100% Formulation 8A | 8B | 8C |
|---|---|---|---|
| Sodium alkylbenzene sulfonate* | 1.65 | 1.65 | 1.65 |
| Soap* | 1.65 | 1.65 | 1.65 |
| Lauric/myristic diethanolamide* | 5.86 | 5.86 | 5.86 |
| Water | 77.83 | 72.83 | 72.83 |
| Sodium Sulfate** | 2.70 | 2.70 | 2.70 |
| Dihydroxymaleic acid** | — | 5.0 | — |
| Dihydroxytartaric acid** | — | — | 5.0 |
| Calcite*** | 10.0 | 10.0 | 10.0 |
| Perfume+ | 0.30 | 0.30 | 0.30 |
| Colorant+ | 0.01 | 0.01 | 0.01 |
| TOTAL | 100.00 | 100.00 | 100.00 |

*tertiary surfactant mixture component
**electrolyte component
***abrasive
+optional ingredient After a contact period of about four to five minutes without agitation, the strips were withdrawn and rinsed with water. Composition 8A left the brown discoloration unchanged. Composition 8B completely removed the discoloration from the ceramic strip and Composition 8C substantially lightened the discoloration.

All compositions exhibited excellent stability under extended storage and exhibited excellent scouring ability on soiled surfaces.

EXAMPLE 9

The following compositions were prepared:

| Component | 9A | 9B | 9C | 9D | 9E |
|---|---|---|---|---|---|
| Sodium alkbenzene sulfonate* | 2.00 | 2.00 | 2.00 | 2.00 | 2.00 |
| Soap(sodium salt of 85:15 blend of tallow and coconut fatty acid)* | 0.64 | 0.64 | 0.64 | 0.64 | 0.64 |
| Lauric diethanolamide* | 2.40 | 2.40 | 2.40 | 2.40 | 2.40 |
| Water | 40.99 | 38.49 | 32.64 | 26.64 | 19.04 |
| Calcite*** | 48.0 | 48.0 | 48.0 | 48.0 | 48.0 |
| Sodium dihydroxymalate** added as | | | | | |
| Dihydroxymaleic acid | 3.00 | 5.00 | 7.50 | 10.00 | 15.00 |
| Sodium hydroxide | 2.15 | 2.60 | 6.00 | 9.50 | 12.10 |
| Attapulgite clay | 0.50 | 0.50 | 0.50 | 0.50 | 0.50 |
| Misc. (including bateriostat flourescent dye, colorant and perfume) | 0.317 | 0.317 | 0.317 | 0.317 | 0.317 |
| TOTAL | 100.0 | 100.0 | 100.0 | 100.0 | 100.0 |

*tertiary surfactant mixture component
**electrolyte component
***abrasive

These compositions exhibited excellent stability, and scouring ability on soiled surfaces.

Ceramic and Formica strips prepared as set forth in Example 6 were contacted with each of the compositions 9A, 9B, 9C, 9D and 9E. After a contact time of about three minuted without agitation, the strips were rinsed with water. Areas contacted by each of the compositions exhibited removal of manganese ion derived discoloration stain.

EXAMPLE 10

The following compositions, 10A through 10EE are examples of various compositions that will give a stable, pourable liquid, abrasive, stain removing product. Enhanced stability may be achieved via the inclusion of for example colloid forming clays. Particular combinations for specific uses may be compounded by one skilled in the art and according to the quality and specific source of materials.

EXAMPLE 10 CONTINUED

| LIQUID PHASE | 10A | 10B | 10C | 10D | 10E | 10F |
|---|---|---|---|---|---|---|
| Tertiary Surfactant Mixture | | | | | | |
| Alkylaryl sulfonate | 1.8 | 1.8 | 1.8 | 1.8 | 1.8 | 2.0 |
| $C_{10}$—$C_{22}$ fatty acid soap | 0.6 | 0.6 | 0.6 | 0.6 | 0.6 | 0.6 |
| Fatty acid alkanolamide | 2.1 | 2.1 | 2.1 | 2.1 | 2.1 | 2.4 |
| Electrolyte | | | | | | |
| Dihydroxymaleic acid | 3.0 | — | — | — | — | 5.0 |
| Dihydroxytartaric acid | — | — | 3.0 | — | — | 2.0 |
| Sodium dihydroxymaleate | — | 3.0 | — | — | 3.0 | — |
| Sodium dihydroxytartrate | — | — | — | 5.0 | — | — |
| Sodium tripolyphosphate | — | — | — | — | — | — |
| Sodium citrate | — | — | — | — | — | — |
| Potassium chloride | — | — | — | 0.5 | — | — |
| Sodium carboxymethyloxysuccinate | — | — | — | — | 0.5 | — |
| Sodium sulfate | — | 0.25 | — | — | — | — |
| SOLID PHASE | | | | | | |
| Calcite | 54.0 | 54.0 | — | — | — | 48.0 |
| Dolomite | — | — | 54.0 | — | — | — |
| Feldspar | — | — | — | — | 54.0 | — |
| Silica flour | — | — | — | — | — | — |
| Pumice | — | — | — | 54.0 | — | — |
| WATER* | to 100% | to 100% | to 100% | to 100% | to 100% | to 100% |

| LIQUID PHASE | 10G | 10H | 10I | 10J | 10K | 10L |
|---|---|---|---|---|---|---|
| Tertiary Surfactant Mixture | | | | | | |
| Alkylaryl sulfonate | 2.0 | 2.0 | 2.5 | 2.5 | 2.5 | 2.5 |
| $C_{10}$—$C_{22}$ fatty acid soap | 0.6 | 0.6 | 0.8 | 0.8 | 0.8 | 0.8 |
| Fatty acid alkanolamide | 2.4 | 2.4 | 3.0 | 3.0 | 3.0 | 3.0 |
| Electrolyte | | | | | | |
| Dihydroxymaleic acid | — | — | — | 5.0 | — | — |
| Dihydroxytartaric acid | — | — | — | — | — | — |
| Sodium dihydroxymaleate | 5.0 | — | 5.0 | 2.5 | 7.0 | — |
| Sodium dihydroxytartrate | — | 5. | — | — | — | 8.0 |
| Sodium tripolyphosphate | — | 0.75 | — | — | — | 2.0 |
| Sodium citrate | — | — | — | — | 1.0 | — |
| Potassium chloride | — | — | — | — | — | — |
| Sodium carboxymethyloxysuccinate | — | — | — | — | — | — |
| Sodium sulfate | — | — | — | 0.25 | — | 0.25 |
| SOLID PHASE | | | | | | |
| Calcite | — | — | 35.0 | — | 20.0 | — |
| Dolomite | — | 48.0 | — | — | — | — |
| Feldspar | — | — | — | — | — | 20.0 |
| Silica flour | 48.0 | — | — | — | — | 15.0 |
| Pumice | — | — | — | 35.0 | 15.0 | — |
| WATER* | to 100% | to 100% | to 100% | to 100% | to 100% | to 100% |

| LIQUID PHASE | 10M | 10N | 10O | 10P | 10Q | 10R |
|---|---|---|---|---|---|---|
| Tertiary Surfactant Mixture | | | | | | |
| Alkylaryl sulfonate | 3.1 | 3.1 | 3.1 | 3.1 | 3.5 | 3.5 |
| $C_{10}$—$C_{22}$ fatty acid soap | 1.0 | 1.0 | 1.0 | 1.0 | 1.1 | 1.1 |

EXAMPLE 10 CONTINUED-continued

| | | | | | | |
|---|---|---|---|---|---|---|
| Fatty acid alkanolamide | 3.7 | 3.7 | 3.7 | 3.7 | 4.2 | 4.2 |
| Electrolyte | | | | | | |
| Dihydroxymaleic acid | 8.0 | — | — | 2.0 | — | 7.5 |
| Dihydroxytartaric acid | — | — | 4.0 | 2.0 | — | — |
| Sodium dihydroxymaleate | — | 8.0 | — | 2.0 | 8.0 | 2.5 |
| Sodium dihydroxytartrate | — | — | 4.0 | 2.0 | — | — |
| Sodium tripolyphosphate | — | — | — | — | — | — |
| Sodium citrate | — | 2.0 | — | — | 2.0 | — |
| Potassium chloride | — | — | — | — | — | — |
| Sodium carboxymethyloxysuccinate | — | — | 1.0 | — | — | — |
| Sodium sulfate | — | — | — | 2.0 | — | — |
| SOLID PHASE | | | | | | |
| Calcite | 20.0 | — | 15.0 | — | 10.0 | — |
| Dolomite | — | 20.0 | — | — | — | — |
| Feldspar | — | — | 5.0 | — | — | — |
| Silica flour | — | — | — | — | — | — |
| Pumice | — | — | — | 20.0 | — | — |
| WATER* | to 100% | to 100% | to 100% | to 100% | to 100% | to 100% |

| LIQUID PHASE | 10S | 10T | 10U | 10V | 10W | 10X |
|---|---|---|---|---|---|---|
| Tertiary Surfactant Mixture | | | | | | |
| Alkylaryl sulfonate | 3.5 | 3.5 | 3.5 | 2.5 | 2.5 | 2.5 |
| $C_{10}$—$C_{22}$ fatty acid soap | 1.1 | 1.1 | 1.1 | 1.6 | 1.6 | 1.6 |
| Fatty acid alkanolamide | 4.2 | 4.2 | 4.2 | 5.1 | 5.1 | 5.1 |
| Electrolyte | | | | | | |
| Dihydroxymaleic acid | — | 5.0 | 10.0 | 3.0 | — | — |
| Dihydrotartaric acid | — | — | — | — | — | — |
| Sodium dihydroxymaleate | — | 5.0 | — | — | 3.6 | 3.0 |
| Sodium dihydroxytartrate | 10 | — | — | — | — | — |
| Sodium tripolyphosphate | — | — | — | — | — | — |
| Sodium citrate | — | — | — | — | — | — |
| Potassium chloride | — | — | — | — | — | — |
| Sodium carboxymethyloxysuccinate | — | 5.0 | — | — | — | 0.6 |
| Sodium sulfate | — | — | — | 0.6 | — | — |
| SOLID PHASE | | | | | | |
| Calcite | — | — | 10.0 | 10.0 | 10.0 | — |
| Dolomite | 5.0 | — | — | — | — | — |
| Feldspar | — | 5.0 | — | — | — | — |
| Silica flour | — | 5.0 | — | — | — | — |
| Pumice | 5.0 | — | — | — | — | 10.0 |
| WATER* | to 100% | to 100% | to 100% | to 100% | to 100% | to 100% |

| LIQUID PHASE | 10Y | 10Z | 10AA | 10BB | 10CC | 10DD | 10EE |
|---|---|---|---|---|---|---|---|
| Tertiary Surfactant Mixture | | | | | | | |
| Alkylaryl sulfonate | 2.5 | 2.5 | 0.75 | 0.75 | 0.75 | 0.75 | 0.75 |
| $C_{10}$—$C_{22}$ fatty acid soap | 1.6 | 1.6 | 0.9 | 0.9 | 0.9 | 0.9 | 0.9 |
| Fatty acid alkanolamide | 5.1 | 5.1 | 2.9 | 2.9 | 2.9 | 2.9 | 2.0 |
| Electrolyte | | | | | | | |
| Dihydroxymaleic acid | 1.5 | 1.5 | — | 1.0 | 3.5 | — | — |
| Dihydroxytartaric acid | — | — | — | 1.0 | — | — | — |
| Sodium dihydroxymaleate | 1.5 | 1.5 | 7.5 | 5.0 | 4.0 | 7.5 | 7.5 |
| Sodium dihydroxytartrate | — | — | 0.25 | 0.5 | — | — | — |
| Sodium tripolyphosphate | 0.6 | — | — | — | — | — | — |
| Sodium citrate | — | 0.6 | — | — | — | — | — |
| Potassium chloride | — | — | — | — | 1.25 | — | — |
| Sodium carboxymethyloxysuccinate | — | — | — | — | — | — | — |
| Sodium sulfate | — | — | — | 0.25 | — | — | — |
| SOLID PHASE | | | | | | | |
| Calcite | 5.0 | — | 52.0 | 48.0 | — | 52.0 | 3.0 |
| Dolomite | — | — | — | — | 32.0 | — | — |
| Feldspar | 5.0 | — | — | — | 20.0 | — | — |
| Silica flour | — | 10 | — | — | — | — | 20.0 |
| Pumice | — | — | — | 4.0 | — | — | — |
| WATER* | to 100% | to 100% | to 100% | to 100% | to 100% | to 100% | to 100% |

*Water may be considered part of the liquid phase and is present in all formulations. Stability of these formulations may be enhanced by addition of colloid forming clays, ammonia, etc.

What is claimed is:

1. A pourable liquid, abrasive, stain removing composition, comprising:

(A) a solid phase, comprising about 5 to about 65 percent, by weight of said composition, of a substantially water insoluble, abrasive material selected from the group consisting of calcite, dolomite, feldspar, silica flour, quartz, pumice, polishing clays and mixtures thereof, dispersed and suspended in;

(b) a stabilizing aqueous liquid phase, comprising (i) about 1 to about 20 percent of a tertiary surfactant mixture, said mixture consisting essentially of:

(a) about 0.25 to about 10 percent, by weight of said composition, of an alkylaryl sulphonate synthetic anionic surfactant;

(b) about 0.25 to about 10 percent, by weight of said composition, of a soap wherein said soap is an alkali metal salt of a ten to twenty-two carbon fatty acid; and (c) about 0.50 to about 10 percent by weight of said composition, of a fatty acid alkanolamide, nonionic surfactant wherein the fatty acid moiety of said amide contains about 8 to about 18 carbon atoms;

wherein the ratio of said soap to said synthetic anionic in said mixture is about 1:3.2 to about 1:0.8, and wherein the ratio of said synthetic anionic surfactant plus said soap to said nonionic surfactant is about 0.6:1 to about 1:0.9; and (ii) about 3 to about 20 percent of an electrolyte system comprising at least one electrolyte selected from the group consisting of dihydroxymaleic acid, of an alkali metal salt of dihydroxymaleic acid, dihydroxytartaric acid, an alkali metal salt of tartaric acid, and mixtures thereof.

2. The composition according to claim 1 wherein said solid phase further comprises a colloid forming clay wherein said clay is present in said composition in an amount up to about 5 percent by weight.

3. The composition according to claim 2 wherein, (a) said soap is a sodium salt of a blend of tallow and coconut fatty acids;

(b) said abrasive is calcite; and (c) said colloid forming clay is attapulgite clay.

4. The composition according to claim 3 wherein said blend of tallow and coconut fatty acids is about 85:15.

5. A pourable liquid, abrasive, stain removing composition comprising:

(A) A solid phase, comprising:

(i) about 48 percent of a water insoluble calcite abrasive; and (ii) about 0.50 percentof attapulgite clay dispersed and suspended in (B) a liquid phase, comprising:

(i) a tertiary soap mixture consisting essentially of:

(a) about 2 percent of a sodium alkylbenzene sulphonate;

(b) about 0.6 percent of a soap wherein said soap is an alkali metal salt of an 85:15 blend of tallow and coconut fatty acids;

(c) about 2.4 percent of nonionic surfactant said nonionic being a blend of lauric and myristic diethanolamide; and (ii) about 5 to about 10 percent dihydroxymaleic acid.

* * * * *